United States Patent [19]

Vincent

[11] Patent Number: 5,074,755

[45] Date of Patent: Dec. 24, 1991

[54] HYDRAULICALLY DRIVEN RECIPROCATING COMPRESSOR HAVING A FREE-FLOATING DIAPHRAGM

[76] Inventor: Ronald J. Vincent, 16 Rudder La., Latham, N.Y. 12110

[21] Appl. No.: 436,308

[22] Filed: Nov. 14, 1989

[51] Int. Cl.[5] ..... F04B 43/06

[52] U.S. Cl. ..... 417/18; 417/383

[58] Field of Search ..... 417/383, 384, 385, 386, 417/387, 388, 63, 395, 18

[56] References Cited

U.S. PATENT DOCUMENTS 3,207,081 9/1965 Bauer ..... 417/395
3,286,640 11/1966 Bauer ..... 417/385
4,705,462 11/1987 Balembois ..... 417/395
4,778,356 10/1988 Hicks ..... 417/395

FOREIGN PATENT DOCUMENTS 0328143 8/1989 European Pat. Off. ..... 417/387

*Primary Examiner*—Leonard E. Smith
*Assistant Examiner*—David W. Scheuermann

[57] ABSTRACT

A compressor with a flexible diaphragm used as the pumping element, said compressor further including a sensor to monitor the position of the diaphragm and a control circuit for maintaining the diaphragm position in a preselected range to avoid contact between the diaphragm and the rest of the compressor. The compressor also includes an expansion member for compensating for the thermal expansion and compressibility of the working fluid of the compressor.

9 Claims, 2 Drawing Sheets

HYDRAULICALLY DRIVEN RECIPROCATING COMPRESSOR HAVING A FREE-FLOATING DIAPHRAGM

BACKGROUND OF THE INVENTION

A. Field of Invention

This invention pertains to hydraulically actuated compressors used for pumping fluids, and more particularly to a compressor with a free-floating diaphragm to reduce wear and tear thereof, thereby increasing the useful life of the compressor and reducing maintenance costs. The invention also relates to means for controlling the reciprocating movement of the diaphragm.

B. Description of the Prior Art

Compressors are used in a wide variety of applications for pumping fluids at different pressures from one environment to another. Frequently compressors include a diaphragm or another flexible member mounted in a chamber, and valve-controlled inlet and outlet ports connected to the chamber. (For the sake of brevity, the term diaphragm shall be used to describe any flexible member useful for fluid pumping). By connecting the inlet port to a fluid source and reciprocating the diaphragm with the inlet and outlet valves operated in synchronism with the diaphragm movement, fluid can be pumped by the compressor efficiently even when there is a high pressure differential between the ports. If necessary, multiple stage compressors may be employed. However, in all the prior art compressors, the extreme positions of the diaphragm were defined either by the walls of the chamber or by stops provided within the chamber. Therefore during each reciprocating motion, the diaphragm collided with, or at least made physical contact with the walls or the stops. These multiple contacts were a major source of wear and tear on both the chamber of the compressor, and the diaphragm itself. In fact frequently diaphragms wore away and broke down first because they were flexible and therefore less resistant to the collisions. Thus the prior art diaphragm compressor had to be overhauled relatively frequently. This feature was highly undesirable in certain important applications such as space stations where a compressor may be used in very critical functions such as pumping oxygen, and wherein maintenance is very difficult to perform at regular intervals.

Furthermore, as a result of the collisions between the diaphragm and the stationary members, particulate matter was produced which entered into and contaminated the fluid being compressed. This type of contamination is undesirable because the contaminant may react with the fluid, or render the fluid unclean.

OBJECTIVES AND SUMMARY OF THE INVENTION

In view of the above-mentioned disadvantages of the prior art, an objective of the present invention is to provide a compressor having a long operating lifetime with low maintenance.

A further objective is to provide a compressor wherein the wear and tear on its members are minimized.

Yet a further objective is to provide a compressor which can be used for pumping fluids in critical applications with minimum fluid contamination.

Other objectives and advantages of the invention shall become apparent from the following description.

A compressor constructed in accordance with this invention includes a closed housing with a cavity holding a working fluid such as a relatively non-compressible liquid. One end of the cavity is defined by a flexible diaphragm. On the other side of the diaphragm, within the housing, there is a compression chamber connected to valved input and output ports. The compressor also includes means for varying the pressure of the working fluid in a cyclical manner to reciprocate the diaphragm along a preselected axis for pumping a fluid through the compression chamber. The compressor further includes sensor means for sensing the position of the diaphragm, and control means coupled to the sensor for controlling the movement of the diaphragm. The sensor means is used by the control means to determine the mean position of the diaphragm to insure that as the diaphragm reciprocates it does not come into contact with any stationary members of the housing. If the mean position of the diaphragm is not within a preselected range along said axis, the mean pressure of the working fluid is changed to shift the mean position of the diaphragm until the desired range is reached.

The compressor may also include fluid pressure compensating means for maintaining the pressure of the working fluid constant even if the working fluid expands or contracts in response to a temperature change.

DETAILED DESCRIPTION OF THE INVENTION

Figure 1:
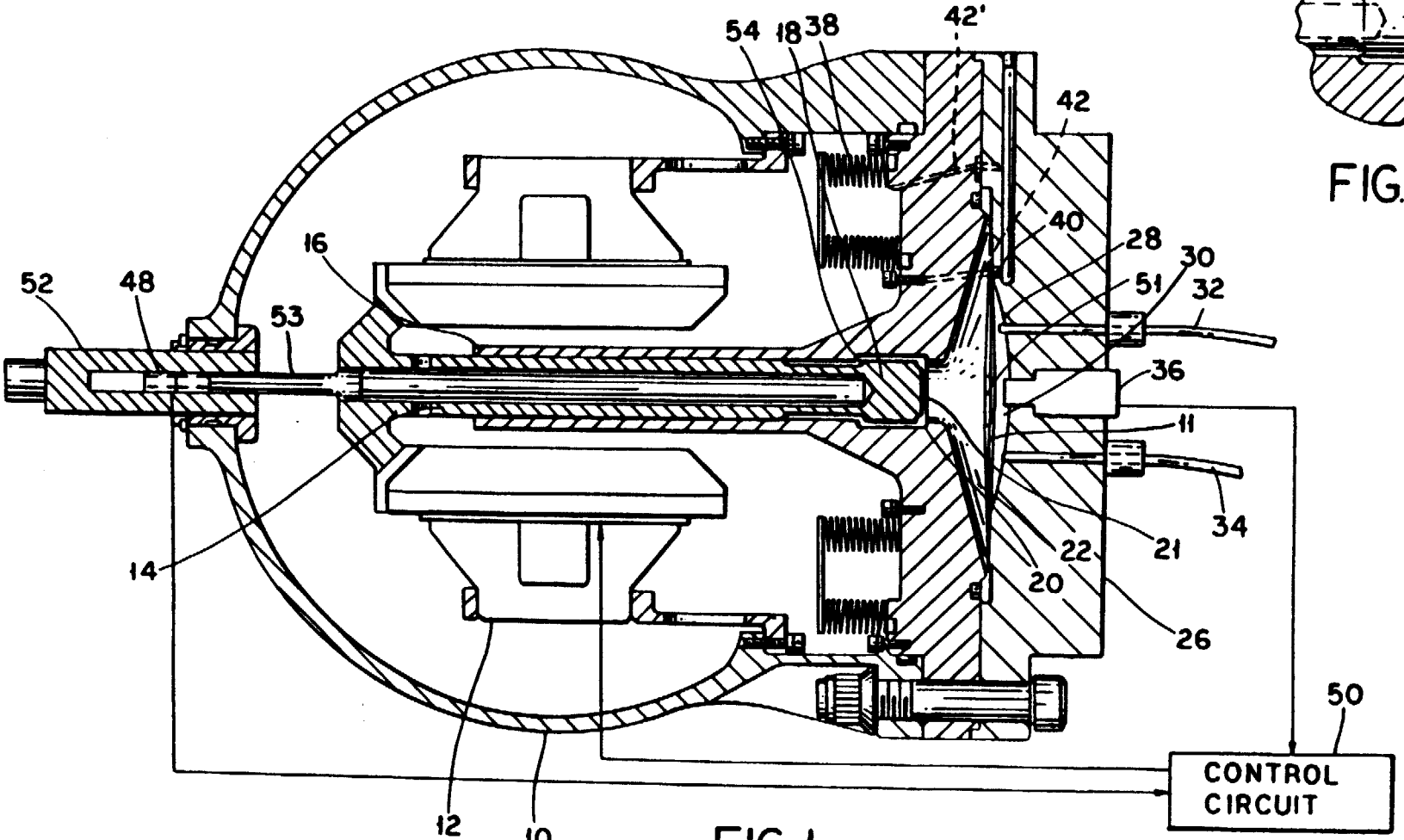
FIG. 1 shows a somewhat schematic side sectional view of a compressor constructed in accordance with this invention.

In FIG. 1 there is shown a hydraulically driven reciprocating compressor in accordance with one embodiment of this invention. The compressor comprises a sealed housing 10, which is closed at one end by a suitable flexible boundary member 11. The flexible boundary member is preferably a flexible diaphragm, as illustrated, arranged to be free-floating, although a bellows or other suitable flexible member similarly arranged to be free-floating may be employed. The housing 10 is filled with a hydraulic liquid, such as water, oil, or any other suitable non-compressible working liquid.

Mounted within the liquid-filled housing 10 is a linear reciprocating motor, which includes a stator 12 and a plunger 14. Stator 12 is supported from the housing 10. A bearing 16 is provided for supporting the plunger 14 for reciprocal movement. Plunger 14 reciprocates within the stator 12 in well known manner when the windings (not shown) of the stator are energized from a suitable AC voltage source. Any suitable linear reciprocating motor may be employed, such as the one disclosed in U.S. Pat. No. 4,827,163, entitled "Monocoil Reciprocating Permanent Magnet Electric Machine with Self-Centering Force", and assigned to Mechanical Technology Incorporated, the assignee of this present invention.

One end of the plunger 14 is provided with a piston 18 which is disposed for reciprocal movement within a cylinder 20. The cylinder 20 communicates at its end 21 with one side of the flexible diaphragm 11 through a manifold 22.

A compressor head 26 is secured to the housing 10 on the other side of flexible diaphragm 11. The compressor head 26 is provided with a formed inner surface 28 which defines a compression chamber 30 with the surface of the diaphragm 11. The compressor also has a valved gas inlet or suction opening 32, and valved gas outlet or discharge opening 34.

A position sensor means 36 is mounted in compressor head 26 for sensing the mid-stroke position of the flexible diaphragm 11. Alternatively, the position sensor means 36 may be mounted on the liquid side of the diaphragm 11 if for any reason it is desired not to have the position sensor located within the compression chamber. Any suitable position or displacement sensing device may be employed, such as a capacitance-type sensing device or a fiber-optical-type displacement sensor, both manufactured and sold by Mechanical Technology Incorporated of Latham, N.Y.; or an eddy current-type sensor such as the Model 25 Probe, manufactured and sold by Kaman Sciences Corporation, Colorado Springs, Colo.

A control circuit 50 is provided to process the signal from the position sensor means 36 to produce an error signal whenever the position of the diaphragm deviates from a preselected range. The position sensor 36 determines the mid-stroke position of the diaphragm, for example, by calculating the arithmetic average between the two extreme positions of a central portion 51 of the diaphragm 11. (If necessary, central portion 51 may be provided with an electrically conductive disk secured to diaphragm 11, or any other means required for the proper operation of sensor 36). If the mid-stroke position of the diaphragm 11 shifts in a direction toward the compressor head 26, the error signal produced is used by controller 50 to shift the axial position of the plunger 14 in a direction away from the compressor head to correct the error. This shifting of the axial position of the plunger 14 may be implemented by changing the DC voltage level of the stator windings. If the mid-position of the diaphragm shifts away from the compressor head, the mid-position of the plunger is shifted toward the compressor head.

To accommodate the changes in liquid volume due to the effects of thermal expansion of the liquid within the sealed housing 10, a volume compensation means 38 is also provided within the liquid-filled housing 10. The volume compensation means 38 is shown as being provided by a flexible bellows. The bellows 38 separates a gas volume within the bellows from the hydraulic liquid and is arranged so that the pressure of such gas volume can be made closely equal to the mean pressure of gas in the compression chamber 30. To this end, restricted communication is provided between the gas volume within the bellows 38 and the compression chamber 30 in any suitable manner. This restricted communication is shown in FIG. 1 as being provided by a porous metal plug 40 disposed in the cylinder head 26 and the conduits 42 and 42' which connect the porous metal plug 40 with the bellows 38 and serves to transmit the mean pressure of the compression chamber 30 to the interior gas volume of the bellows 38. Any other suitable means for achieving a restricted communication may be employed, such as for example, a small orifice, a capillary, or the like. The path should be suitably restricted so as to avoid introducing excessive dead volume.

The compressor may also be provided with a plunger stroke sensing means by arranging for a suitable sensor 48 to be associated with an extension 53 of the shaft of plunger 14 opposite the piston 18 and a cooperating extension 52 of housing 10 into which the shaft 53 moves. Any suitable sensor may be employed, such as an inductive type (LV/DT), or similar sensor for sensing the position of the shaft. The output of sensor 48 is also fed to control circuit 50 as shown. This type of stroke sensing means is especially useful in a two-stage compressor arranged in opposed relationship as shown schematically in FIG. 3. In this arrangement the strokes of the two pistons are always 180 degrees out of phase and it is desirable that the momentums of both the first and second-stage plunger assemblies always be maintained equal and opposite. Therefore, if the masses of the two plunger assemblies are made equal, then equal and opposing strokes will ensure that the fundamental component of vibration imposed on the compressor case is always zero.

Figure 2:
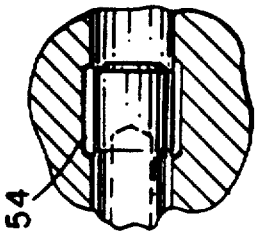
FIG. 2 shows an enlarged detail of the compressor of FIG. 1 illustrating a center port.

Piston 18 partitions the chamber holding the working liquid into two sections; one section disposed between the piston and the diaphragm, and a second section disposed behind the piston. When the piston is at or near its mean position, i.e. half way between is maximum and minimum positions, the piston cooperates with a center port 54 to allow liquid to flow between the two sections thereby tending to equalize the pressure therebetween. Preferably this port is formed by making localized milled slots on the inner surface of cylinder 20. As shown in detail in FIG. 2, the axial dimension of the center port 54 is longer than the axial dimension of piston 18 to allow the liquid to flow past the piston when the piston is located over the center port.

The mean position of the diaphragm 11 is defined by the relative positions of the center port 53 and piston 18. If the mean position of diaphragm 11 is too close for example to wall 28 the mean pressure within manifold 22 must be decreased. This is accomplished by moving the mean position of piston 18 back, away from diaphragm 11. The interaction of fluid pressures and the timing of center port opening then causes fluid to be transferred out of manifold 22 and the mid-stroke position of the diaphragm is corrected. If the mean position of diaphragm 11 is too far from wall 28 then the mean position of the piston 18 is shifted toward the diaphragm 11. In this manner the diaphragm 11 is positioned so that it does not come into contact with any portion of housing 10 or wall 28 thereby reducing wear and tear. Of course, the center port may be constructed in other ways as well. Furthermore, the slot forming the center port may be formed in a sleeve movably mounted inside cylinder 20. The control circuit 50 may then compensate for the shift in the mean position of the diaphragm by moving the sleeve axially rather than changing the mean position of the piston 18.

Figure 3:
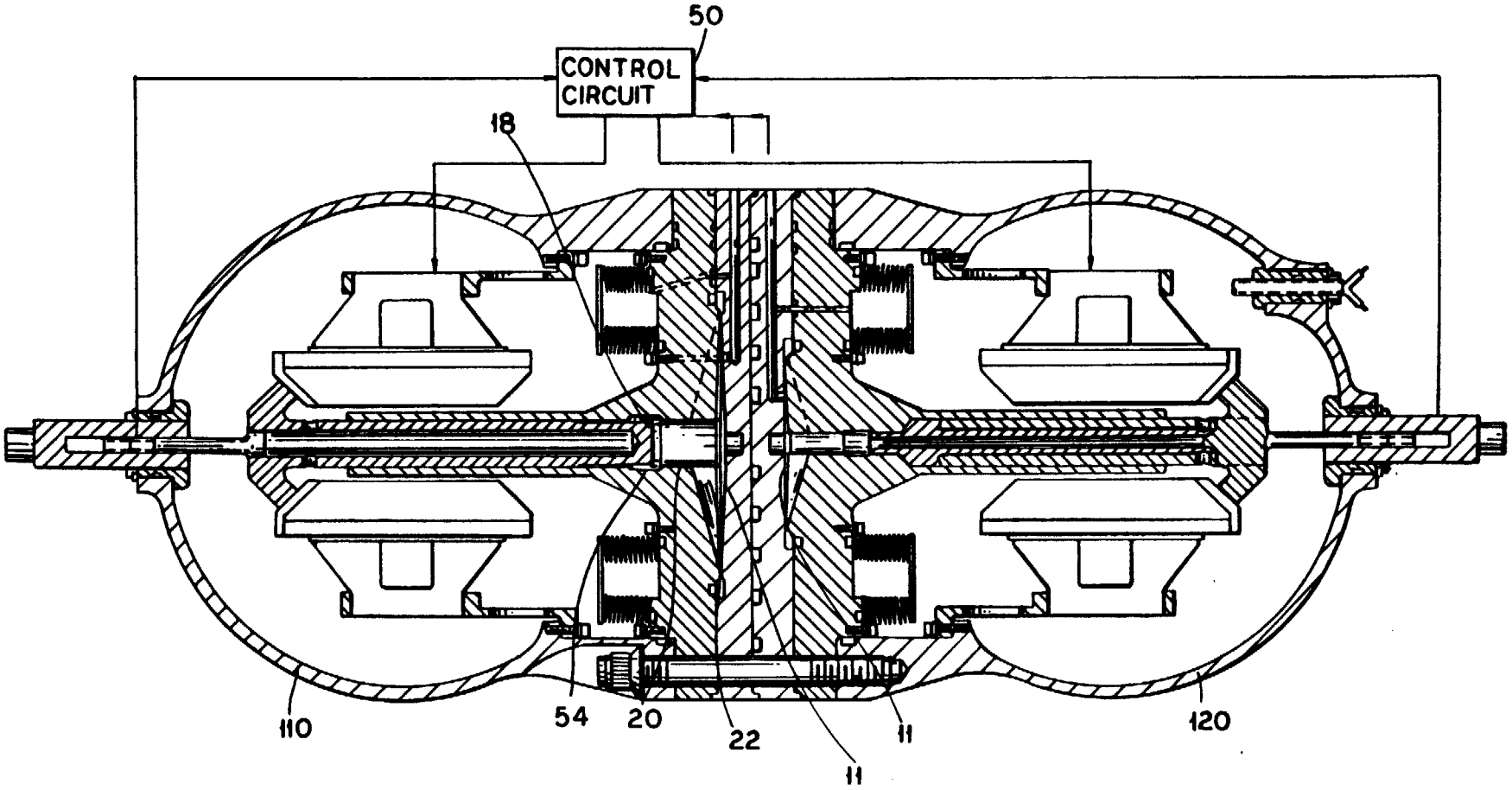
FIG. 3 shows a two- stage compressor constructed in accordance with this invention.

In FIG. 3 there is shown a compressor in accordance with this invention arranged in a two-stage configuration. As shown, the two-stage compressor includes two housings 110 and 120 similar to that shown in FIG. 1 mounted back-to-back. The higher pressure second stage compressor housing 120 has a smaller diaphragm and piston than that of the lower pressure stage 110.

Obviously numerous modifications may be made to the invention without departing from its scope as defined in the appended claims.

We claim:

1. A compressor for compressing transfer fluids comprising:

a. a housing including a cavity and a flexible membrane partitioning said cavity into a first chamber for holding a working fluid and a second chamber for a transfer fluid;

b. pressure means for cyclically changing the pressure within said working fluid for reciprocating said membrane, said membrane and said second chamber cooperating to pump said transfer fluid in response to the reciprocation of said membrane;

c. sensor means for sensing the position of said membrane for generating a position signal;

d. control means for receiving said position signal;

e. adjusting means operating by said control means for adjusting the position of said membrane to eliminate contact between said membrane and said housing while said membrane means is reciprocated; and f. expansion means for compensating for the thermal expansion and compressibility of said working fluid.

2. The compressor of claim 1 wherein said housing means includes a piston for selectively pressurizing the working fluid adjacent to said membrane.

3. A compressor for compressing a transfer fluid comprising:

a. a housing with a cavity for holding a working fluid, said housing including a flexible diaphragm defining a wall of said cavity;

b. pressurizing means for selectively pressurizing the working fluid in contact with said diaphragm;

c. compressor chamber means disposed in contact with said diaphragm opposite said cavity;

d. input and output port means connected to said compressor chamber means for feeding and receiving said transfer fluid to and from said compressing chamber respectively;

e. position sensing means for sensing the position of said diaphragm and for generating a corresponding position signal;

f. control means for controlling the position of said diaphragm in response to said position signal, said control means positioning said diaphragm to avoid contact with said housing; and g. piston means reciprocatively disposed in said cavity for reciprocating said diaphragm;

h. motor means coupled to said control means for controlling the movement of said piston means; and i. wherein said piston partitions said cavity into a first section adjacent to said diaphragm and a second section, said compressor further including center port means for allowing working fluid flow between said sections when said piston is in a preselected position.

4. The compressor of claim 3 wherein said diaphragm has a mean diaphragm position and said piston has a mean piston position related to said diaphragm mean position, said control means adjusting said diaphragm mean position by changing said piston mean position.

5. The compressor of claim 3 wherein said diaphragm position is dependent on the relative distance between said piston mean position and the position of said center port.

6. The compressor of claim 5 wherein said housing includes a piston cylinder hosing said piston, and wherein said center port consists of at least one localized slot formed on the wall of said piston cylinder.

7. The compressor of claim 3 further comprising expansion means for compensating for the thermal expansion and compressibility of said working liquid.

8. The compressor of claim 6 wherein said expansion means consists of a bellows disposed in said cavity and pressure equalizing means for equalizing the pressure between said bellows and said compression chamber.

9. The compressor of claim 3 further including piston sensor means for sensing the position of said piston.

* * * * *

UNITED STATES PATENT AND TRADEMARK OFFICE

CERTIFICATE OF CORRECTION

PATENT NO. : 5,074,755

DATED : December 24, 1991

INVENTOR(S) : Ronald J. Vincent

It is certified that error appears in the above-identified patent and that said Letters Patent is hereby corrected as shown below:

On the Title page, Item [73], insert "Mechanical Technology Incorporated, Latham, New York" as the assignee.

Signed and Sealed this

Sixth Day of April, 1993

*Attest:*

STEPHEN G. KUNIN

*Attesting Officer*

*Acting Commissioner of Patents and Trademarks*